United States Patent [19]

Swarovski

[11] 4,069,622

[45] Jan. 24, 1978

[54] IMPROVEMENTS IN OR RELATING TO AN ABRASIVE WHEEL

[75] Inventor: Daniel Swarovski, Wattens, Austria

[73] Assignee: Tyrolit-Schleifmittelwerke Swarovski K.G., Schwaz, Austria

[21] Appl. No.: 721,551

[22] Filed: Sept. 8, 1976

Related U.S. Application Data

[63] Continuation of Ser. No. 523,553, Nov. 13, 1974, abandoned, which is a continuation of Ser. No. 347,668, April 4, 1973, abandoned.

[30] Foreign Application Priority Data

May 15, 1972 Austria ..... 4199/72

[51] Int. Cl.[2] ..... B24D 5/06; B24D 5/08

[52] U.S. Cl. ..... 51/206.5; 51/206 NF

[58] Field of Search ..... 51/206 NF, 206.4, 206.5; 29/98, 101; 125/15, 22

[56] References Cited

U.S. PATENT DOCUMENTS

| | | | |
|---|---|---|---|
| 146,680 | 1/1874 | Husbands | 125/22 |
| 237,472 | 2/1881 | Blackburn | 125/15 UX |
| 1,502,697 | 7/1924 | Tone | 51/206.5 |
| 1,697,505 | 1/1929 | Hyde | 51/206.5 |
| 2,092,591 | 9/1937 | Sohlstrom | 51/206 NF |
| 3,162,187 | 12/1964 | Christensen | 125/15 |
| 3,176,675 | 4/1965 | Bomba | 51/206.4 X |
| 3,282,263 | 11/1966 | Christensen | 125/15 |
| 3,307,242 | 3/1967 | Cofran | 125/22 X |
| 3,633,637 | 1/1972 | Kolesh | 125/15 |
| 3,795,078 | 3/1974 | Coes | 51/206.5 |

FOREIGN PATENT DOCUMENTS

| | | | |
|---|---|---|---|
| 1,026,618 | 2/1953 | France | 125/15 |
| 580,394 | 8/1958 | Italy | 51/206 NF |

*Primary Examiner*—Gary L. Smith

*Attorney, Agent, or Firm*—Wenderoth, Lind & Ponack

[57] ABSTRACT

An abrasive wheel assembly, preferably an abrasive cut-off wheel, includes a plurality of segments, each of which comprises an embedded fixing or securing plate, preferably metal, that is inserted to a certain degree into the segment and has a projecting rim part securable to a circular blade. The segment further comprises a core material, e.g. glass fiber, that extends over the total height of the segment.

4 Claims, 3 Drawing Figures

IMPROVEMENTS IN OR RELATING TO AN ABRASIVE WHEEL

This is a Continuation, of application Ser. No. 523,553, filed Nov. 13, 1974, now abandoned which is a continuation of application Ser. No. 347,668, filed Apr. 4, 1973, now abandoned.

BACKGROUND OF THE INVENTION

The invention relates to an abrasive wheel assembly, particularly for abrasive cut-off wheels of the consumable type, i.e. of the type which are used up by the grinding operation, and which are provided with a circular preferably metallic blade and abrasive segments attached to the blade and having conical or parallel lateral surfaces and plane securing plates of preferably metallic material resistant to bending. The securing plates extend into the circular blade, and the abrasive segments are securable to and removable from the circular or polygonal periphery of the circular blade, whereby the portion of the securing plate embedded in the segment adheres to the segment over the entire area of contact.

The invention particularly relates to segments for a grinding or abrasive wheel operable to economically groove or cut workpieces having a large cross section.

Though abrasive or cut-off wheels with the above-mentioned structure are already known, at least in literature, so-called one-piece wheels have generally been used up to now in cutting metallic workpieces. In one-piece wheels of this kind the entire wheel consists of grain bonds, reinforcing means and fillers without being provided with an actual blade, made, for instance, of metal.

The manufacture of such wheels with a diameter of more than 800 mm involves considerable difficulties and in addition such cut-off wheels are economically usable only for a limited time. This disadvantage is particularly due to the fact that cut-off wheels of this kind must be relatively thick, firstly for reasons of manufacture, and secondly to be able to absorb strong centrifugal and component forces occuring in operation. However, in use only a relatively small marginal portion of the wheel may wear away. Further usage of such wheels for cutting smaller cross sections on smaller machines is obstructed by excessive material loss, the necessity of increased dynamic stresses thereby conditioning considerable overload of the engine and the machines, as well as an increase in temperature occuring in the cross section to be cut, thereby causing damage to the workpiece and the cut-off wheel.

In this connection it is to be noted that on an average the breadth of the wheel is supposed to measure 1% of the external diameter of the cut-off wheel. Accordingly, the breadth of the wheel used as the cutting surface, in the cut-off wheels which now can be built to a diameter up to 1500mm, may measure up to 15 mm. Consequently, a substantial portion of cut-off wheels now employed remains unused.

On the other hand, the cut-off wheels hitherto known provided with a reusable, for instance, metallic blade and abrasive segments securable to its periphery are not satisfactory in practice. The difficulties thereby reside in the fixing of the segments to the blade.

The operator should be able to easily and rapidly replace and secure the segments on the spot where the machine is positioned without needing auxiliary persons or means. However, the fixing has to ensure the positioning and alignment of the segments since a minor misalignment of the segments in operation may involve their breakage. In this connection the legal safety rules requiring a minimum burst speed of one and a half of the operating speed must also be considered.

An example of solving this problem has been a proposal according to which each segment is provided with a continuous metallic blade, the rim of which extends out of the segment and is securable to the blade.

It is true that this proposal solves the problems of alignment and guiding of the segments and prevents setting, but only by renouncing the good grinding qualities of the segmental abrasive wheel. The safety rules for cutting at high speed (more than 60m/s) require, however, a securing plate with a minimum thickness of 2mm. However, a plate of this kind does not wear down in operation. As a result, a segment with a continuous sheet is unusable.

Even at a lower grinding speed the usage of a wheel of this kind involves practical problems. Specifically, because of core armoring, that is because of the securing plate being continuous, the segments cannot wear down equally. But what is even more important, because of the unequal wear of the securing plate and the abrasive material and the missing homogeneity of the grinding area of the segments it cannot be prevented that several parts break out, thereby making an operation impossible, particularly in view of the safety rules in force.

SUMMARY OF THE INVENTION

It is therefore the object of the present invention to create an abrasive wheel assembly, in particular a cut-off abrasive wheel assembly permitting not only the exact alignment of the segments but also an optimal use of the grinding qualities of the abrasive material.

According to the invention this object is achieved by providing the segments with an abrasive portion which contains no securing plate and is fitted with a known fibrous core material extending over the total radial height of the segment in the interior thereof on the side of the securing plate.

In a preferred embodiment of the invention the fibrous core-material extends in the interior of the segment on both sides of the securing plate.

BRIEF DESCRIPTION OF THE DRAWINGS

An embodiment of the invention will now be described with reference to the accompanying drawings without the invention being limited thereto.

DETAILED DESCRIPTION OF THE INVENTION

Figure 1:
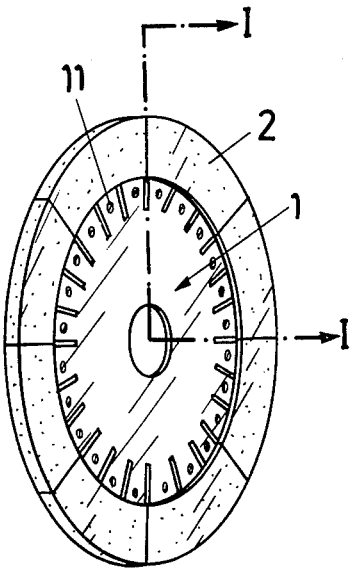
FIG. 1 is a perspective view of an abrasive cut-off wheel according to the invention.
Figure 2:
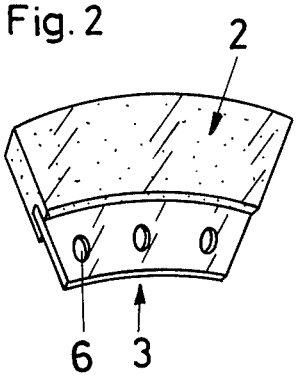
FIG. 2 is a perspective view of a segment according to the invention.

Referring to FIG. 1 the cut-off wheel according to the invention consists of a metallic blade 1 having around the periphery thereof a plurality of segments 2, substantially in the form of a circle.

In the lower portion of segments 2 constituting the actual abrasive parts a perferably metallic securing plate 3 is embedded.

Figure 3:
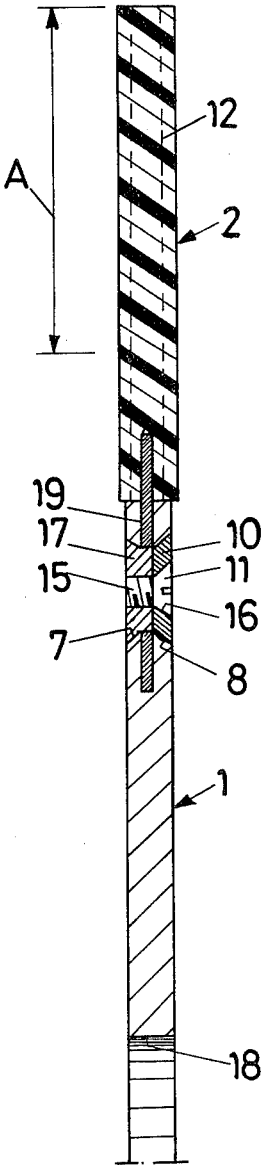
FIG. 3 is an enlarged section taken on line I—I of FIG. 1.

As can be seen in FIG. 3 segments 2 on both sides of the securing plate 3 are fitted with mats 12, such as webs or the like, of for instance, glass fiber, extending over the total radial height of segment 2 in planes paralled to the plane of plate 3. The webs of glass fiber or mats 12 wear away together with the abrasive material of segments 2.

The portion of securing plate 3 embedded in segment 2 on its surfaces may be provided with recesses.

The rim of securing plate 3 extending out of segment 2 is provided with securing holes 6 which correspond to and align with fixing bores 7 and 8 of blade 1.

As can be seen in FIG. 3 blade 1 is fitted with a circumferential groove 19, into which the rims of securing plates 3 are engageable.

In the embodiment shown in FIG. 3 fixing bores 7 and 8 are countersunk and provided with insertions 17 and 10. Screw 11 engages on the one hand thread 15 of insertion 17 and on the other hand bevel 16 of insertion 10, insertion 17 through its portion extending into groove 19 thereby behaving as a adjusting jacket.

The advantage of such a construction resides in the substantially longer thread. In addition insertion 17 is replaceable in case of a stripped thread, so that the blade need not be threaded, such operation requiring considerable time.

The cut-off wheel according to the invention through its hub 18 is mountable on a traditional abrasive cut-off wheel and operable in the usual manner.

When portion A has worn away the individual segments are removed from the blade and replaced by new segments 2. The used securing plates 3 and the material arranged on the sides thereof may be discarded.

Though securing plates 3 preferably are made of metallic material, but other materials, as for instance synthetics, may also be used, provided that securing plates 3 made thereof are suitably solid and rigid.

What we claim is:

1. An abrasive wheel of the consumable type comprising:

a circular blade mountable on a grinding machine;

a plurality of abrasive segments positioned around the periphery of said circular blade, each of said abrasive segments including a segment formed of a bonded abrasive material of the type consumable during a grinding operation, a securing plate having a portion imbedded in said segment only a portion of the radial height thereof and a portion not imbedded in said segment, the thickness in the axial direction of said securing plate being uniform throughout the radial height thereof and less than the thickness in the axial direction of said segment, each of said segments and plates having lateral edges forming extensions of radii of said circular blade, the radial portion of said segment having no plate imbedded therein forming a plate-free abrasive portion, and a pair of webs of fibrous core material located only in said segment and extending through said segment over the total radial height thereof on opposite sides of said securing plate in planes parallel to the plane of said securing plate;

said circular blade having an annular groove extending radially inwardly from the outer periphery thereof, said annular groove defining two separate axially spaced blade portions;

said securing plate portions not imbedded in said segments extending into said annular groove between said spaced blade portions;

each said securing plate portion within said groove having therethrough a securing hole;

said spaced blade portions having a plurality of pairs of axially aligned tapered fixing bores therethrough;

each pair of axially aligned fixing bores being axially aligned with a securing hole of a respective one of said securing plate portions;

at least a first fixing bore of each said pair of fixing bores having a tapered insertion therein, said insertion having a threaded opening therethrough; and a plurality of retainer means, each of said retainer means having a tapered first portion positioned within a second fixing bore of a respective pair of fixing bores and a threaded second portion threaded into said opening of said insertion, for selectively removably securing and detaching said securing plate portions not imbedded in the respective segments to said securing plate.

2. An abrasive wheel as claimed in claim 1, wherein said second fixing bore of each said pair of fixing bores has therein a tapered insertion, having a tapered opening therethrough, and said tapered first portion of each said retainer means is positioned within said respective tapered opening.

3. An abrasive wheel as claimed in claim 1, wherein said lateral edges of said segment and said plate comprise abutting means between circumferentially adjacent of said abrasive segments to form a contiguous abrasive wheel, and said securing and detaching means comprises means for securing said securing plates to said circular blade with the abutting means of adjacent of said abrasive segments in abutting contact.

4. An abrasive wheel as claimed in claim 1, wherein said fibrous core material is spaced in the axial direction from said portion of said securing plate imbedded in said segment.

* * * * *